US010093092B2

(12) United States Patent
Fukuda

(10) Patent No.: US 10,093,092 B2
(45) **Date of Patent: *Oct. 9, 2018**

(54) LIQUID EJECTING HEAD AND LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/458,758

(22) Filed: Mar. 14, 2017

(65) Prior Publication Data

US 2017/0182774 A1 Jun. 29, 2017

Related U.S. Application Data

(63) Continuation of application No. 14/455,763, filed on Aug. 8, 2014, now Pat. No. 9,656,468.

(30) Foreign Application Priority Data

Aug. 9, 2013 (JP) ..... 2013-165724

(51) Int. Cl.
*B41J 2/14* (2006.01)

(52) U.S. Cl.
CPC ..... *B41J 2/14201* (2013.01); *B41J 2202/12* (2013.01)

(58) Field of Classification Search
CPC ..... B41J 2/14201
See application file for complete search history.

(56) References Cited

U.S. PATENT DOCUMENTS 6,616,270 B1 9/2003 Miyata et al.
2003/0015492 A1* 1/2003 Koike ..... B41J 2/161 216/27

(Continued)

FOREIGN PATENT DOCUMENTS

JP 2000289193 10/2000
JP 2001293864 10/2001

(Continued)

OTHER PUBLICATIONS

Notice of Allowance issued in U.S. Appl. No. 14/455,763, dated Jan. 4, 2017.
Office Action issued in U.S. Appl. No. 14/455,763, dated Sep. 8, 2016.
Office Action issued in U.S. Appl. No. 14/455,763, dated May 12, 2016.

(Continued)

*Primary Examiner* — Shelby Fidler
(74) *Attorney, Agent, or Firm* — Workman Nydegger

(57) ABSTRACT

By appropriately defining a flow path capacity from an opening of an ink supply path to a nozzle in a pressure chamber, a progress of thickening ink toward the pressure chamber is suppressed. In other words, by setting the individual flow path capacity to be large, specifically, to 4400 pl or higher, desirably 6210 pl or higher, it is possible to suppress the progress of the thickening of the ink even in a small-sized liquid ejecting head of which the shortest formation pitch between each of the nozzles is 1/300 inches. More specifically, a nozzle communication opening is provided between the pressure chamber and the nozzle, and a total capacity of the nozzle communication opening and the pressure chamber is configured to be 4400 pl or higher, desirably 6210 pl or higher.

18 Claims, 4 Drawing Sheets

(56) References Cited

U.S. PATENT DOCUMENTS

| | | | | |
|---|---|---|---|---|
| 2003/0025767 | A1 | 2/2003 | Sakamoto et al. | |
| 2003/0107622 | A1 | 6/2003 | Sugahara | |
| 2004/0233257 | A1* | 11/2004 | Satake | B41J 2/14233 347/71 |
| 2005/0110833 | A1 | 5/2005 | Kodama | |
| 2005/0213020 | A1 | 9/2005 | Takeda et al. | |
| 2006/0050111 | A1 | 3/2006 | Mataki | |
| 2006/0261034 | A1 | 11/2006 | Kurashima et al. | |
| 2007/0046154 | A1 | 3/2007 | Ifuku et al. | |
| 2007/0211090 | A1 | 9/2007 | Hibi et al. | |
| 2008/0224571 | A1 | 9/2008 | Miyazawa et al. | |
| 2009/0075085 | A1 | 3/2009 | Reichelsheimer | |
| 2009/0278892 | A1 | 11/2009 | Silverbrook | |
| 2010/0001095 | A1 | 1/2010 | Matsumoto et al. | |
| 2011/0148992 | A1 | 6/2011 | Miyazawa et al. | |
| 2012/0069101 | A1* | 3/2012 | Kato | B41J 2/14233 347/70 |
| 2014/0340438 | A1 | 11/2014 | Sato et al. | |

FOREIGN PATENT DOCUMENTS

| | | |
|---|---|---|
| JP | 2003231254 | 8/2003 |
| JP | 2005313628 | 11/2005 |
| JP | 2006-082448 A | 4/2006 |
| JP | 2008-258575 A | 10/2008 |
| JP | 2012232498 | 11/2012 |
| JP | 2012255090 | 12/2012 |
| WO | 2012018561 | 2/2012 |

OTHER PUBLICATIONS

Office Action issued in U.S. Appl. No. 14/455,763, dated Nov. 20, 2015.

Office Action issued in U.S. Appl. No. 14/455,763, dated Jun. 12, 2015.

Office Action issued in U.S. Appl. No. 14/455,763, dated Jan. 15, 2015.

* cited by examiner

LIQUID EJECTING HEAD AND LIQUID EJECTING APPARATUS

This application is a Continuation of U.S. application Ser. No. 14/455,763 filed Aug. 8, 2014, which is expressly incorporated herein by reference. The entire disclosures of Japanese Patent Application Nos. 2013-165724, filed Aug. 9, 2013 is expressly incorporated by reference herein in its entirety.

BACKGROUND

1. Technical Field

The present invention relates to a liquid ejecting head (such as an ink jet type recording head) and a liquid ejecting apparatus. The invention particularly relates to a liquid ejecting head which ejects liquid introduced to a pressure chamber from a liquid supply path, from a nozzle, and relates to a liquid ejecting apparatus.

2. Related Art

A liquid ejecting apparatus includes a liquid ejecting head which can eject liquid as liquid droplets from a nozzle. The liquid ejecting apparatus is an apparatus which ejects various types of liquid from the liquid ejecting head. Representative examples of the liquid ejecting apparatus include an image recording apparatus, such as an ink jet type recording apparatus (printer) which has an ink jet type recording head (hereinafter, referred to as a recording head), ejects liquid ink as ink droplets from the nozzle of the recording head, and performs recording. In addition, other than that, the liquid ejecting apparatus is used in ejecting various types of liquid, such as a coloring material used in a color filter of a liquid crystal display or the like, an organic material used in an organic Electro Luminescence (EL) display, or an electrode material used in forming an electrode. At the recording head for the image recording apparatus, the liquid ink is ejected. At a coloring material ejecting head for a display manufacturing apparatus, a solution of each coloring material of Red (R), Green (G), and Blue (B) is ejected. In addition, at an electrode material ejecting head for an electrode forming apparatus, a liquid electrode material is ejected. At a bio-organic material ejecting head for a chip manufacturing apparatus, a solution of a bio-organic material is ejected.

Inside the liquid ejecting head (which employs an ink jet technology) are provided a plurality of nozzles, a pressure chamber formed in each nozzle, a common liquid chamber (referred to as a reservoir or a manifold) which is common to the plurality of pressure chambers, a liquid supply path which respectively communicates with the common liquid chamber and each of the pressure chambers, and the like. By driving pressure generating means, such as a piezoelectric element or a heating element, a pressure change is applied to a liquid in the pressure chamber, and the liquid ejecting head is configured to eject the liquid from the nozzle by using the pressure change.

As the liquid ejecting head, various configurations are suggested. For example, a liquid ejecting head (ink jet type recording head) disclosed in JP-A-2001-293864 has a so-called longitudinal vibration type piezoelectric vibrator which vibrates in a longitudinal direction (a direction which is orthogonal to an electric field direction) of the piezoelectric vibrator) as a pressure generating means. After laminating and curing a piezoelectric body layer made of zirconia or lead zirconate titanate having an electrode layer at a surface thereof, the piezoelectric vibrator is manufactured through a step of dividing into a combtooth shape. Each one of the divided combteeth functions as the piezoelectric vibrator corresponding to each pressure chamber. The longitudinal vibration type piezoelectric vibrator is difficult to be made small, and is generally mounted on a comparatively large liquid ejecting head. In that type of the liquid ejecting head, an established pitch of the nozzles has an interval equivalent to, for example, 1/180 inches (that is, approximately 141 μm). Corresponding to this, it is possible to ensure a comparatively large capacity of a flow path of the pressure chamber or the like which communicates with the nozzle.

In contrast, a liquid ejecting head disclosed in JP-A-2003-231254 is made smaller than the liquid ejecting head disclosed in JP-A-2001-293864. The piezoelectric vibrator used in the liquid ejecting head is configured to have respectively laminated and formed a lower electrode, a piezoelectric body layer made of a piezoelectric material, and an upper electrode by a film forming technology (and to be divided for every pressure chamber by patterning by etching such as lithography), and ion milling. The piezoelectric vibrator is a so-called bending vibration type piezoelectric vibrator which is bent and deformed in the electric field direction. Compared to the above-described longitudinal vibration type piezoelectric vibrator, the bending vibration type piezoelectric vibrator can be made smaller. For this reason, the bending vibration type piezoelectric vibrator contributes to having a smaller sized liquid ejecting head on which the piezoelectric vibrator is mounted as pressure generating means. In the type of liquid ejecting head, the established pitch (distance between the centers) of the nozzles has an interval equivalent to, for example, 1/300 inches (that is, approximately 84.66 μm). Compared to JP-A-2001-293864, higher density of the nozzles can be achieved. For this reason, the capacity of the flow path of the pressure chamber or the like is limited.

However, in the type of liquid ejecting head, since the liquid (meniscus) in the nozzle is exposed to outside air, a solvent component included in the liquid evaporates, and the liquid thickens with passage of time. As the recording head disclosed in JP-A-2003-231254, the small-sized liquid ejecting head, of which the nozzles are formed in a high density, relates to the capacity of the pressure chamber and is smaller compared to the recording head which is comparatively large disclosed in JP-A-2001-293864. For this reason, in the small-sized liquid ejecting head, the liquid is comparatively likely to thicken from a nozzle side to the inside of the pressure chamber. When the liquid inside the pressure chamber thickens, ejection characteristics (such as an amount of the liquid ejected from the nozzle, or a flying speed (flying direction)) changes from an ideal state. In order to reduce such defects, in the liquid ejecting apparatus provided with such a liquid ejecting head (recording head), for example, a maintenance process (flushing process) is performed in which the liquid is forced to be ejected from the nozzle regularly during a recording process (ejecting process) with respect to a recording medium (landing object of the liquid), and the thickened liquid is discharged. However, in the flushing process, a printing process is temporarily suspended, the liquid is moved to a flushing point, and the liquid is discarded from all of the nozzles. Therefore, if the flushing process is performed frequently, there are problems that a processing capability (throughput) per unit time is deteriorated during the printing process, and the liquid is uselessly consumed.

When progress of thickening changes the interval of performing the flushing process in the small-sized recording head (to be described in detail, for example, a head B or C in FIG. 3), a rate of discharging of liquid (necessary consumption amount of the liquid in eliminating thickening) which is necessary in the flushing process is high. In other words, a performance of the liquid ejecting head is likely to be influenced by a length of the flushing interval. For this reason, when the liquid ejecting head is mounted on the liquid ejecting apparatus, it is necessary to specifically set the flushing interval to be within a comparatively short range, and there is a problem that it is hard to handle the liquid ejecting head.

SUMMARY

An advantage of some aspects of the invention is to provide a liquid ejecting head and a liquid ejecting apparatus which can suppress thickening of liquid, improve a throughput, and reduce consumption of the liquid in a maintenance process.

The liquid ejecting head according to an aspect of the invention is a liquid ejecting head suggested for achieving the above-described advantages. The liquid ejecting head includes a plurality of nozzles which eject the liquid, a plurality of pressure chambers which respectively communicate with the plurality of nozzles, and a plurality of liquid supply paths which respectively communicate with each pressure chamber and supply the liquid to the pressure chambers. The shortest formation pitch between each of the nozzles is equal to or less than 1/300 inches. A capacity of a flow path from an opening of the liquid supply path to the nozzle in the pressure chamber is equal to or higher than 4400 pl.

According to the aspect of the invention, by setting the capacity of the flow path from the opening of the liquid supply path to the nozzle in the pressure chamber to equal to or higher than 4400 pl, it is possible to suppress a progress of thickening of the liquid even in a comparatively small-sized liquid ejecting head in which the shortest formation pitch between each of the nozzles is equal to or less than 1/300 inches (equal to or less than 84.66 μm). Accordingly, in the liquid ejecting apparatus on which the liquid ejecting head is mounted, the performance interval of the maintenance process (flushing process) which is regularly performed during a liquid ejecting process is extended. In other words, since a performance frequency can be reduced, it is possible to improve a liquid discharging processing capability (throughput) per unit time and suppress the amount of the liquid which is consumed in the maintenance process. Since a rate of change of discharging amount of liquid which is necessary during the maintenance process can be suppressed with respect to a change in the performance interval of the maintenance process, it is possible to further widen a setting range of the performance interval of the maintenance process, and to realize a liquid ejecting head which is easier to handle.

In the above-described configuration, it is desirable that the capacity of the flow path be equal to or higher than 6210 pl.

According to the above-described configuration, by setting the capacity of the flow path from the opening of the liquid supply path to the nozzle in the pressure chamber to equal to or higher than 6210 pl, the progress of thickening of the liquid can be further suppressed, and thus it is possible to further reduce a change in ejecting characteristics caused by the thickening of the liquid. For this reason, while an accuracy in a liquid landing position is maintained with respect to a landing object, it is possible to improve the liquid ejecting processing capability and to reduce the consumption amount of the liquid in the maintenance process.

In the above-described configuration, it is desirable to employ a configuration in which a communication opening that causes the pressure chamber and the nozzle to be communicating is provided.

In addition, in the above-described configuration, a communication opening substrate in which the communication opening is established is provided between a pressure chamber substrate on which the pressure chamber is formed and a nozzle substrate on which the nozzle is formed.

It is desirable that a thickness of the communication opening substrate be equal to or more than 200 μm.

According to the above-described configuration, by adjusting the capacity of the communication opening which causes the pressure chamber and the nozzle to be communicating, it is possible to set the capacity of the flow path from the opening of the liquid supply path to the nozzle in the pressure chamber to 4400 pl or higher without drastically changing the capacity of the pressure chamber, that is, without changing a height of a partition that separates the pressure chambers. Accordingly, a rigidity of the partition is prevented from deteriorating, and thus it is possible to suppress so-called adjacent crosstalk which is generated as the partition is deformed according to a pressure change of the liquid in the pressure chamber. In addition, since a length of the pressure chamber is not longer than necessary, it is possible to suppress an increase in size of the liquid ejecting head as much as possible.

Furthermore, a configuration in which a water content with respect to a total amount of liquid composition of the liquid is within a range of 10 mass % or more and 60 mass % or less, can be employed.

In addition, the liquid ejecting apparatus according to another aspect of the invention includes the liquid ejecting head in any one of the above-described configurations.

According to the invention, by employing the above-described liquid ejecting head, the performance interval of the maintenance process (flushing process) which is regularly performed during a liquid ejecting process is extended. In other words, since a performance frequency can be reduced, it is possible to improve a liquid discharging processing capability (throughput) per unit time and suppress the amount of the liquid which is consumed in the maintenance process. Since the rate of change of the necessary consumption amount of the liquid during the maintenance process can be suppressed with respect to a change in the performance interval of the maintenance process, it is possible to further widen the setting range of the performance interval of the maintenance process, and to correspond to wider range of applications.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to drawings. In addition, in the embodiment described below, the embodiment is limited to an appropriate specific example of the invention. However, the scope of the invention is not limited thereto unless a specific description that limits the invention is mentioned. In addition, hereinafter, as an example of a liquid ejecting head of the invention, a recording head 2 will be described, which is one type of the liquid ejecting head.

Figure 1:
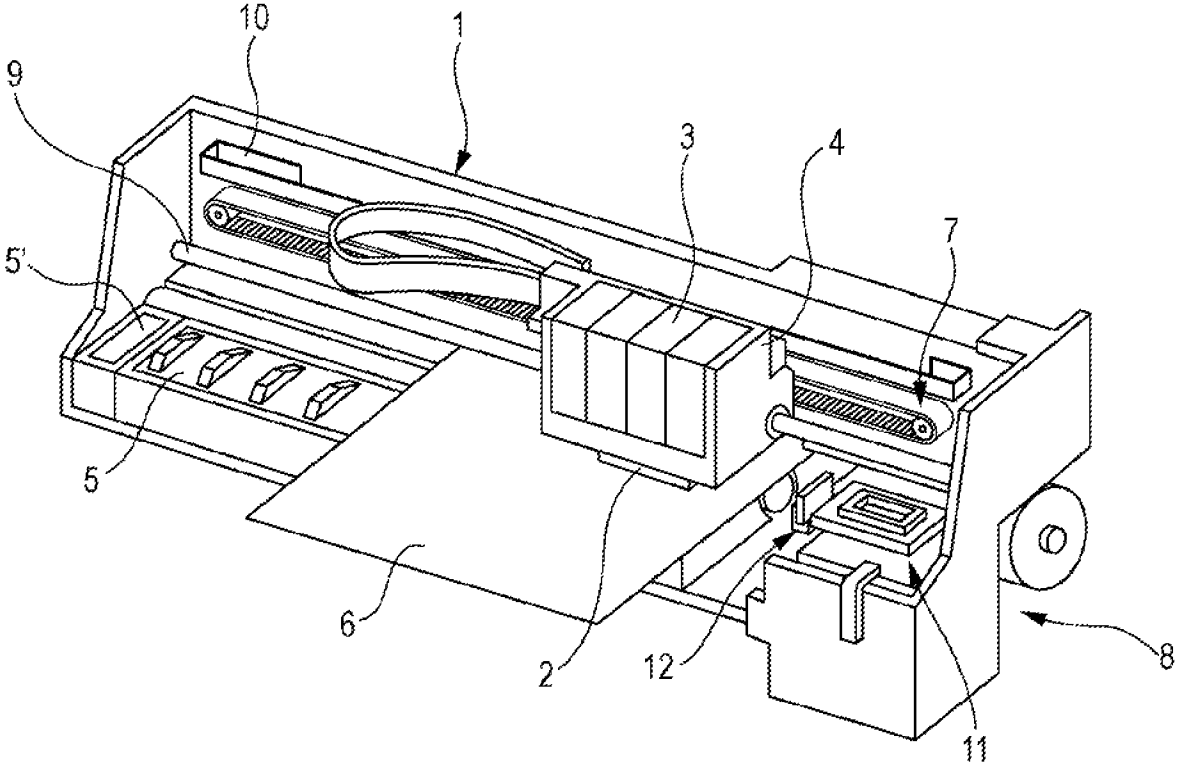
FIG. 1 is a perspective view illustrating a configuration of a printer.

FIG. 1 is a perspective view illustrating a configuration of a printer 1. The printer 1 includes a carriage 4 to which a recording head 2 is attached and an ink cartridge 3 (which is one type of a liquid supply source) is detachably attached; a platen 5 which is disposed below the recording head 2 during a recording operation; a carriage movement mechanism 7 which reciprocally moves the carriage 4 in a paper width direction, that is, a main scanning direction of recording paper 6 (one type of a recording medium and a landing object); and a paper feeding mechanism 8 which transports the recording paper 6 in an auxiliary scanning direction perpendicular to the main scanning direction.

The carriage 4 is attached to a guide rod 9 installed in the main scanning direction in a pivotally supported state. The carriage 4 is configured to be moved in the main scanning direction along the guide rod 9 by an operation of the carriage movement mechanism 7. A position of the main scanning direction of the carriage 4 is detected by a linear encoder 10, and a detection signal thereof (that is, an encoder pulse) is transmitted to a printer controller (not shown). The linear encoder 10 is one type of position information output means, and outputs the encoder pulse corresponding to a scanning position of the recording head 2 as position information in the main scanning direction. For this reason, based on the received encoder pulse, the printer controller can recognize the scanning position of the recording head 2 that is mounted on the carriage 4. In other words, for example, by measuring the received encoder pulse, it is possible to recognize a position of the carriage 4. Accordingly, the printer controller can control a recording operation of the recording head 2, while recognizing the scanning position of the carriage 4 (recording head 2) based on the encoder pulse from the linear encoder 10.

A home position, which is a base point of scanning of a carriage, is set in an end portion region which is outside of a recording region within a movement range of the carriage 4. At the home position in the embodiment, a capping member 11 is disposed which seals a nozzle forming surface (nozzle substrate 15: refer to FIGS. 2A to 2C) of the recording head 2. A wiper member 12 for wiping the nozzle forming surface is also disposed at the home position. In addition, a flushing box 5' is provided as a flushing region at the other end portion in the main scanning direction. The platen 5 is interposed between the home position and the flushing box 5'. The flushing box 5' is a member which receives the ink ejected during the maintenance process (flushing process) in which the ink is forced to be ejected from a nozzle 23 of the recording head 2 regardless of the recording process with respect to the recording paper 6. The printer 1 is configured to be able to perform a so-called bidirectional recording which records characters, an image, or the like on the recording paper 6, in two directions of a forward direction when the carriage 4 moves toward the end portion of an opposite side from the home position, and of a backward direction when the carriage 4 moves toward the home position side from the end portion of the opposite side.

Figure 2A:
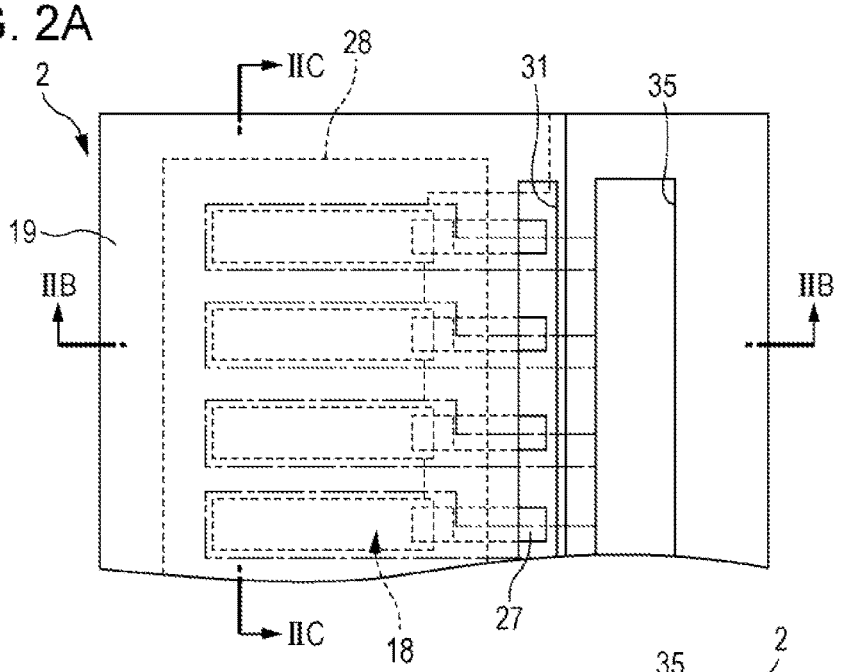
FIGS. 2A to 2C are views illustrating a configuration of a recording head.
Figure 2B:
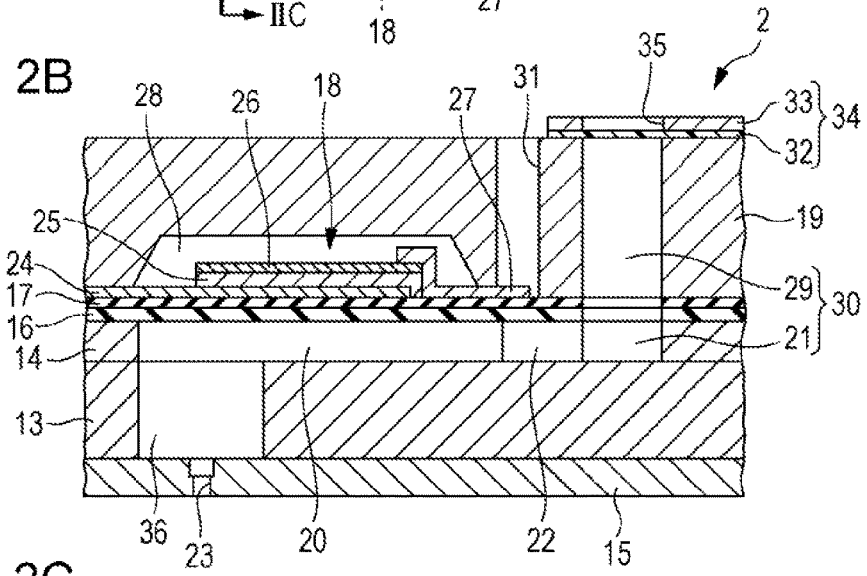
Figure 2C:
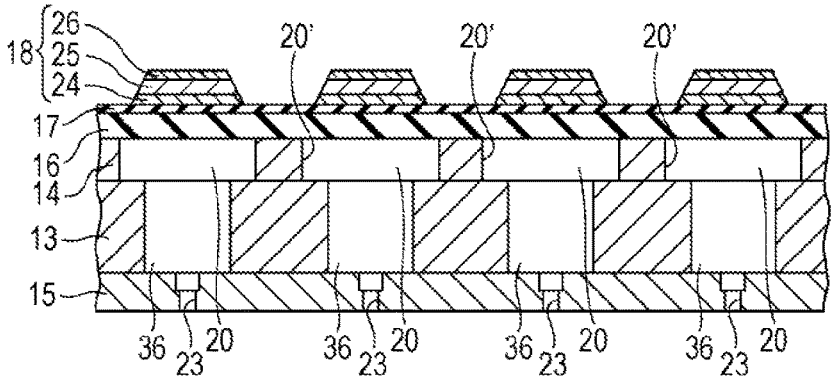

FIGS. 2A to 2C are views illustrating a configuration of the recording head 2 of the embodiment. FIG. 2A is a plan view of the recording head 2. FIG. 2B is a cross-sectional view taken along the line IIB-IIB in FIG. 2A. FIG. 2C is a cross-sectional view taken along the line IIC-IIC in FIG. 2A. The recording head 2 according to the embodiment is configured by laminating a pressure chamber substrate 14, a communication opening substrate 13, a nozzle substrate 15, an elastic film 16, an insulator film 17, a piezoelectric element 18, a protection substrate 19, and the like.

The pressure chamber substrate 14 is, for example, a board material which is made of a single crystal silicon substrate. On the pressure chamber substrate 14, a plurality of pressure chambers 20 are provided in parallel in a width direction (nozzle row direction) thereof, while interposing a partition 20' therebetween. The pressure chamber 20 in the embodiment is set to have a height of 70 μm, a width of 70 μm, and a length of 569 μm (depth in a direction orthogonal to the nozzle row direction). The capacity of the pressure chamber 20 is 2788 pl. Here, it is desirable that a thickness of the pressure chamber substrate (that is, a height of the pressure chamber 20) be set to 70 μm or less, from the viewpoint of ensuring that a rigidity of the partition 20' that separates adjacent pressure chambers 20 is equal to or higher than a certain level. In other words, the thickness (or the width of the pressure chamber 20) of the partition 20' is determined according to a formation pitch between each of the nozzles 23. However, when the height of the pressure chamber 20 is higher than necessary (while the thickness of the partition 20' is maintained at a certain level) the rigidity of the partition 20' is accordingly deteriorated. If the rigidity of the partition 20' is not sufficiently ensured, the partition 20' is bent according to the pressure change in the pressure chamber 20 when the ink is ejected. Accordingly, there is a problem that so-called adjacent crosstalk is generated that changes the ejecting characteristics (such as the amount of the ink ejected from the nozzle 23, or a flying speed). Therefore, the height of the pressure chamber 20 is determined considering the above-described point. In addition, since the longer the length of the pressure chamber 20 is, the larger the dimensions of the recording head 2 in a planar direction (direction which is parallel to a surface of the nozzle substrate 15), there is a problem that the size of the recording head 2 is large. In addition, according to this, dimensions of other members, such as the piezoelectric element 18 increase, and there is a problem that the cost increases correspondingly. Therefore, each dimension of the pressure chamber 20 and the capacity thereof are determined to have a value within a certain range from each of the above-described conditions, and basically, it is not preferable that that these values be greatly changed.

In a region of the pressure chamber substrate 14 deviating to the outside of the pressure chamber 20 in a longitudinal direction, a communication portion 21 is formed. The communication portion 21 and each pressure chamber 20 communicate with each other via an ink supply path 22 (corresponding to the liquid supply path in the invention) provided for every pressure chamber 20. In addition, the communication portion 21 constitutes a part of a reservoir 30 which communicates with a reservoir portion 29 of the protection substrate 19 (to be described below) and is an ink chamber common to each pressure chamber 20. A flow path cross sectional area (cross sectional area in the nozzle row direction) of the ink supply path 22 is smaller than a cross sectional area of the pressure chamber 20. In the embodiment, the width of the ink supply path 22 in the nozzle row direction is set to 22 μm, and is formed to be narrower than the width of the pressure chamber 20 in the same direction. In addition, the length (depth) of the ink supply path 22 is 135 μm. The flow path of these pressure chambers 20, the ink supply path 22, or the like on the pressure chamber substrate 14 is formed by anisotropic etching.

The communication opening substrate 13 is provided between the pressure chamber substrate 14 and the nozzle substrate 15. Similar to the pressure chamber substrate 14, the communication opening substrate 13 is a board material which is made of silicon single crystal substrate. As the communication opening substrate 13 is connected to a lower surface of the pressure chamber substrate 14, an opening of the pressure chamber 20 on a lower surface side is sealed by the communication opening substrate 13 and a bottom portion of the pressure chamber 20 is defined. In the communication opening substrate 13, a nozzle communication opening 36 (corresponding to the communication opening in the invention) is formed in a state where the nozzle communication opening penetrates the substrate. The nozzle communication opening 36 is an empty portion which communicates with the pressure chamber 20 of the pressure chamber substrate 14 and the nozzle 23 of the nozzle substrate 15. More specifically, an upper end of the nozzle communication opening 36 communicates with an end portion opposite to the ink supply path 22 of the pressure chamber 20 in the longitudinal direction, and a lower end of the nozzle communication opening 36 communicates with the nozzle 23. The nozzle communication opening 36 in this embodiment is set to have a height of 400 μm (that is, a thickness of the communication opening substrate 13), a width of 58 μm, and a depth of 155 μm (depth being the dimension in a direction parallel to the longitudinal direction in the pressure chamber). The capacity of the nozzle communication opening 36 is 3596 pl. It is desirable that the thickness (that is, the height of the nozzle communication opening 36) of the communication opening substrate 13 be set to 200 μm or more.

The nozzle substrate 15 (in which the plurality of nozzles 23 is established in a row shape corresponding to each pressure chamber 20) is connected to a lower surface (a surface opposite to a surface which is connected with the pressure chamber substrate 14) of the communication opening substrate 13. The nozzle substrate 15 is a board material which is made of a metal plate of stainless steel, a single crystal silicon substrate, or the like. Each nozzle 23 is a through-hole which is formed in a cylindrical shape by dry etching or the like. In the embodiment, an internal diameter of a side (which communicates with the nozzle communication opening 36 in the nozzle 23) is set to be slightly larger than an internal diameter of a side where the ink is ejected. The height (that is, a thickness of the nozzle substrate 15) of the nozzle 23 is set to 65 μm, and the internal diameter of the ejecting side of the nozzle 23 is set to 21 μm. In addition, a shape of the nozzle 23 may be a cylindrical shape which has a regular inner diameter, or may be a shape which has a so-called tapered portion in which the internal diameter of the side that communicates with the nozzle communication opening 36 is inclined toward the nozzle communication opening 36 and gradually increases. On the nozzle substrate 15 in the embodiment, the nozzles 23 are provided in parallel at a pitch (distance between the centers of adjacent nozzle) corresponding to 300 dpi of a dot forming density (that is, of 1/300 inches (84.66 μm)). Therefore, the forming interval in the pressure chamber substrate 14 between each of the pressure chambers 20 that respectively communicates with each nozzle 23, is also 1/300 inches.

On an upper surface of the pressure chamber substrate 14, an elastic film 16 is formed and is made of, for example, silicon dioxide ($SiO_2$. On the elastic film 16, an insulator film 17 is formed and is made of zirconium oxide ($ZrO_2$). A portion (which seals the opening of the pressure chamber 20 in the elastic film 16 and in the insulator film 17) functions as an operating surface. In addition, on the insulator film 17, a lower electrode 24, a piezoelectric body 25, and an upper electrode 26 are formed, and constitute the piezoelectric element 18 in a laminated state. In general, any one of electrodes of the piezoelectric element 18 is configured as a common electrode, and the other electrode (positive electrode or individual electrode) and the piezoelectric body 25 are configured for every pressure chamber 20 by patterning. A portion, which is configured by any one of the electrodes and piezoelectric body 25 which are patterned, and in which a piezoelectric distortion is generated by applying a voltage to both of the electrodes, is referred to as a piezoelectric active portion. In addition, in the embodiment, the lower electrode 24 is the common electrode of the piezoelectric element 18, and the upper electrode 26 is the individual electrode of the piezoelectric element 18. However, it is possible to have an entirely reversed configuration, according to a polarization direction of the piezoelectric body 25, a situation of a drive circuit or a wiring, or the like. In all cases, the piezoelectric active portion is formed for every pressure chamber 20. In addition, lead electrodes 27, which are made of, for example, gold (Au), are respectively connected to the upper electrodes 26 of each piezoelectric element 18.

The protection substrate 19 is connected to a surface on the pressure chamber substrate 14 on the piezoelectric element 18 side. The protection substrate 19 has a piezoelectric element retaining portion 28 which is a space having a size to an extent that the dislocation thereof is not suppressed in a region facing the piezoelectric element 18. Furthermore, on the protection substrate 19, the reservoir portion 29 is provided in a region corresponding to the communication portion 21 of the pressure chamber substrate 14. The reservoir portion 29 is formed on the protection substrate 19 as a through-hole having a long rectangular opening shape along the juxtaposition direction of the pressure chamber 20, communicates with the communication portion 21 of the pressure chamber substrate 14 as described above, and defines the reservoir 30 (one type of common liquid chamber). The reservoir 30 is provided for every ink type (every color), and stores common ink in the plurality of pressure chambers 20. As the ink, it is possible to use various well-known types of ink, such as dye inks, pigment inks. However, in this embodiment, pigment ink is used, of which a water content is 10 mass % or more and 60 mass % or less with respect to the total amount of the ink composition, is used. As the pigment ink, it is possible to use the pigment ink disclosed in JP-A-2012-255090 or in JP-A-2000-289193, for example. In addition, the ink is not limited to the pigment ink, and if the ink has a water content of 10 mass % or more and 60 mass % or less with respect to the total amount of the ink composition, it is possible to obtain substantially similar evaluation results. In the embodiment, by using the pigment ink, the performance (the flushing amount which is necessary with respect to a degree of thickening of the ink or the flushing interval) of the recording head 2 is evaluated. This point will be described below.

In addition, in a region between the piezoelectric element retaining portion 28 of the protection substrate 19 and the reservoir portion 29, a through-hole 31 is provided, which penetrates the protection substrate 19 in a thickness direction. Inside the through-hole 31, a part of the lower electrode 24 and a tip end portion of the lead electrode 27 are exposed. A compliance substrate 34 (which is made of a sealing film 32 and a fixing board 33) is connected to the protection substrate 19. The sealing film 32 is made of a material (for example, polyphenylene sulfide film) having a plasticity, and one surface of the reservoir portion 29 is sealed by the sealing film 32. In addition, the fixing board 33 is formed of a hard material (for example, stainless steel), such as metal. The region facing the reservoir 30 of the fixing board 33 is an opening portion 35 which penetrates in the thickness direction. For this reason, one surface of the reservoir 30 is sealed only by the sealing film 32 having a plasticity.

In the recording head 2 of the above-described configuration, the ink is supplied from ink supply means, such as an ink cartridge, and a space from the reservoir 30 to the nozzle 23 is filled with the ink. When a driving signal is supplied from a main body side of the printer, the electric field is applied according to a potential difference between both electrodes between the lower electrode 24 and the upper electrode 26, which respectively correspond to the pressure chambers 20. As the piezoelectric element 18 and the operation surface (elastic film 16) are bent and deformed, the pressure change is generated in the pressure chamber 20. By suppressing the pressure change, the ink is ejected from the nozzle 23, or a meniscus in the nozzle 23 is finely vibrated to an extent that the ink is not ejected.

However, in the liquid ejecting head such as the recording head 2, since the liquid (meniscus) in the nozzle is exposed to the outer air, the solvent component included in the liquid evaporates, and the liquid thickens with elapse of time. Like the recording head 2 in this embodiment, in the small-sized liquid ejecting head in which the nozzles are formed in high density of a pitch of 1/300 inches or less (shortest distance between the centers of each nozzle), the capacity of the pressure chamber is made smaller. For this reason, the liquid is easy to thicken progressively from the nozzle side to the inside of the pressure chamber. When the ink is thickened, there is a concern that the amount of the ink ejected from the nozzle, the flying speed (flying direction), or the like, changes from an ideal state. In order to reduce such defects, the flushing process is regularly performed during the recording process (printing process) with respect to the recording medium, such as recording paper, and the thickened ink is discharged. However, in the flushing process, the printing process is temporarily suspended, the recording head is moved to the flushing point, such as the flushing box, and the ink is discarded from all of the nozzles. Therefore, if the flushing process is performed frequently, there are problems that the processing capability (throughput) per unit time is deteriorated in the printing process, and the ink is uselessly consumed.

In the recording head 2 according to the invention, by appropriately regulating the capacity (hereinafter, referred to as an individual flow path capacity, appropriately, regardless of the presence or the absence of the nozzle communication opening) of the flow path from the opening (an outlet of the ink supply path 22 or an inlet to the pressure chamber 20) of the ink supply path 22 to the nozzle 23 (to the front of the nozzle 23) in the pressure chamber 20, the progress of thickening of the ink toward the pressure chamber 20 is suppressed. In other words, by setting the individual flow path capacity to be larger, specifically to 4400 pl or higher, it is possible to suppress the progress of thickening of the ink even in the small-sized liquid ejecting head. As described above, since the capacity of the pressure chamber 20 is generally determined according to the various conditions, in the embodiment, the nozzle communication opening 36 is provided between the pressure chamber 20 and the nozzle 23, and the total capacity of the nozzle communication opening 36 and the pressure chamber 20 is configured to be 4400 pl or higher. In addition, the capacity of the nozzle 23 is sufficiently small compared to the total capacity of the nozzle communication opening 36 and the pressure chamber 20, and it is possible to neglect (be within an error range) the capacity of the nozzle 23 during the performance evaluation, and thus the capacity of the nozzle 23 is not included in calculation.

Figure 3:
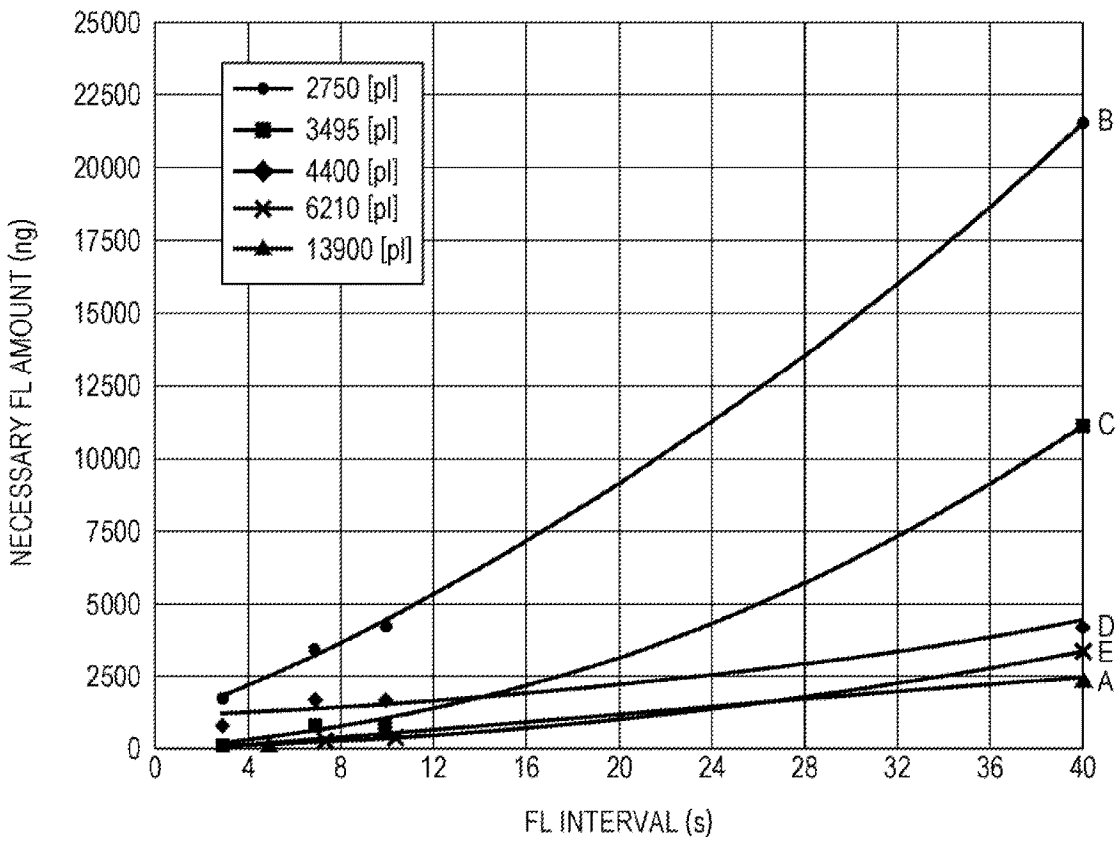
FIG. 3 is a graph illustrating a relationship between a flushing interval and a necessary flushing amount.

FIG. 3 is a graph illustrating a relationship between a flushing (FL) interval and a necessary flushing amount. The flushing interval [s] of a horizontal axis represents a time from starting the printing process to performing the initial flushing process, or a time from completing the flushing process to starting the following flushing process. In addition, the necessary flushing amount [ng] of a vertical axis is an amount of the ink discharged from the nozzle 23 during the flushing process, and represents a necessary discharging amount to substantially discharge the thickened ink in the pressure chamber 20, that is, an ink discharging amount which is obtained when an ejecting capability is recovered to an extent that the defects caused by the thickened ink are not generated. In the example of FIG. 3, a deviation of a ruled line recorded on a forward path and a backward path in a test pattern described below is allowed to approximately 25 μm, and the flushing interval and the flushing amount are set to be within the range. In addition, the pigment ink illustrated above as an example is used as the ink, and a performance evaluation test is performed.

In a case where the above-described test pattern is formed, first, during the first pass (scanning of the forward path), the ink is simultaneously ejected from each nozzle 23 which configures the same nozzle row, and thus a dot group is formed on a predetermined position in the recording medium, a part of the ruled line is recorded, and the recording medium is transported in the auxiliary scanning direction by the length of the nozzle row. After that, during a second pass (scanning of the backward path), the ink is ejected from each nozzle 23, and the following dot group is formed at a timing (timing which is adjusted in advance during manufacturing the printer 1) which succeeds that of the previously formed dot group. It is possible to recognize the thickening level according to how much the ruled line formed on the forward path and the ruled line formed on the backward path are deviated. In the embodiment, the deviation of the ruled line is set at the flushing interval to be within the maximum 25 μm. In addition, if it is possible to recognize the deviation of the landing position due to the change in the flying direction of the ink due to thickening, the test pattern is not limited to the above-described vertical ruled line.

Here, in FIG. 3, a relationship is illustrated between the necessary FL amount and the FL interval of a plurality of recording heads which have different individual flow path capacities. The recording head corresponding to A in FIG. 3 is a comparatively large-sized head of which the nozzle forming density is 1/180 inches or more, and deviates from the condition (the shortest pitch of the nozzles is 1/300 inches or less) of the invention. If the recording head is a large-sized recording head, it is also reliably possible to ensure that the above-described individual flow path capacity is large, and the largest example thereof is 13900 ng. For this reason, the change in the necessary FL amount when the FL interval is changed is the smallest. The recording head corresponding to B in FIG. 3 is a comparatively small-sized head of which the shortest pitch of the nozzles is 1/300 inches or less, and is configured not to have a portion which corresponds to the nozzle communication opening 36 in the above-described recording head 2. The recording head of B is not likely to ensure the individual flow path capacity, and the smallest example thereof is 2750 pl. In other words, in the recording head of B, it is not possible to ensure 4400 pl or higher which is the condition of the invention. For this reason, the change in the necessary FL amount when the FL interval is changed is the largest.

The recording head corresponding to C in FIG. 3 is a comparatively small-sized recording head of which the shortest pitch of the nozzles is 1/300 inches or less, and is configured to have a portion (hereinafter, simply referred to as a nozzle communication opening) corresponding to the nozzle communication opening 36 in the above-described recording head 2. A thickness of the communication opening substrate on which the nozzle communication opening is formed is 100 μm. The individual flow path capacity in the recording head of C is 3495 ng, and deviates from the condition of the invention which is 4400 pl or higher. Since it is possible to ensure a large individual flow path capacity from the recording head of B which does not have the nozzle communication opening, the change of the necessary FL amount when the FL interval is changed is suppressed by the recording head of B, and is not sufficient. As a result, the frequency of the flushing process or the ink consumption is comparatively large. The recording head corresponding to D in FIG. 3 is a comparatively small-sized recording head of which the shortest pitch of the nozzles is 1/300 inches or less, and is configured to have the nozzle communication opening. The thickness of the communication opening substrate on which the nozzle communication opening is formed is 200 μm. Accordingly, the capacity of the nozzle communication opening is also larger than that of the recording head of C. For this reason, the capacity of the above-described flow path in the recording head of D is 4400 pl which is within the condition of the invention. For this reason, the change in the necessary FL amount when the FL interval is changed is greatly suppressed compared to the recording head of B or C which does not satisfy the condition of the invention. Therefore, it is also possible to greatly reduce the frequency of the flushing process or the ink consumption, compared to a case of the recording head of B or C.

The recording head corresponding to E in FIG. 3 is a comparatively small-sized recording head of which the shortest pitch of the nozzles is 1/300 inches or less, and is configured to have the nozzle communication opening. The thickness of the communication opening substrate on which the nozzle communication opening is formed is 400 μm. Accordingly, the capacity of the nozzle communication opening is also much larger than that of the recording head of D. The capacity of the above-described flow path in the recording head of E is 6210 pl which is the largest among the recording heads of 1/300 inches or less. For this reason, the change in the necessary FL amount when the FL interval is changed is further suppressed compared to the recording head of D, and is reduced to an extent close to that of the recording head of A. In other words, it is possible to much further suppress the progress of thickening of the ink. For this reason, the deviation of the landing position of the ink from an original target in the recording paper 6 can be suppressed. Therefore, it is also possible to further reduce the frequency of the flushing process or the ink consumption, compared to a case of the recording head of D.

Figure 4:
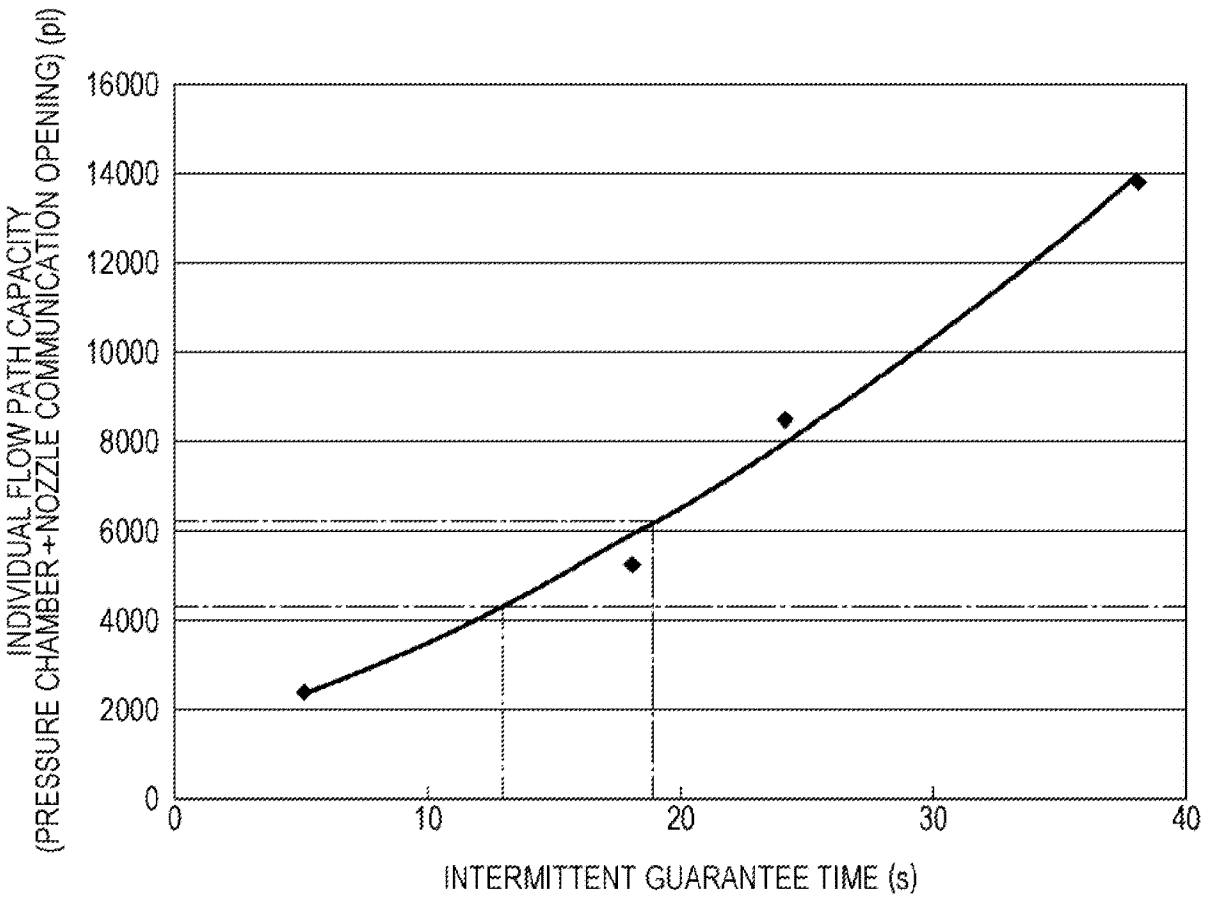
FIG. 4 is a graph illustrating a relationship between an individual flow path capacity and an intermittent guarantee time.

FIG. 4 is a graph illustrating a relationship between the individual flow path capacity and an intermittent guarantee time. A horizontal axis is the intermittent guarantee time [s], and a vertical axis is the individual flow path capacity [pl]. Here, the intermittent guarantee time represents, for example, a maximum value of the flushing interval in a case where the deviation of the ruled line which is recorded on the forward path and the backward path in the test pattern is allowed to be up to around 20 μm. In other words, the intermittent guarantee time is the flushing interval in which the deviation of the ruled line is ensured to be suppressed to within 20 μm which is yet narrower than the above-described 25 μm. As illustrated in the same drawing, the greater an individual flow path capacity is, the longer the intermittent guarantee time is. When the individual flow path capacity is 4400 pl, the intermittent guarantee time is 13 s. In contrast, when the individual flow path capacity is 6210 pl, the intermittent guarantee time is 19 s, and it is possible to greatly (+46%) extend the intermittent guarantee time while the deviation of the ruled line is maintained at around 20 μm, which is performance with the high accuracy.

In such a manner, by setting the individual flow path capacity from the opening of the ink supply path 22 to the nozzle 23 in the pressure chamber 20 to be 4400 pl, it is possible to suppress the progress of the thickening of the ink even in the small-sized liquid ejecting head of which the shortest pitch of the nozzles 23 is 1/300 inches or less. Accordingly, the flushing interval can be extended, that is, the frequency of performing the flushing process can be reduced, and thus it is possible to improve the printing processing capability per unit time, and to suppress the ink consumption. Since the rate of change of the ink consumption during the flushing process with respect to the change in the flushing interval is suppressed, it is possible to further widen the setting range of the flushing interval, and to realize the recording head 2 which is easily handled. For example, the movement distance of the recording head 2 is comparatively long, and the recording head 2 can correspond to a wider range of applications, such as an application in which the recording is performed with respect to a much longer recording medium. By setting the individual flow path capacity to be 6210 pl, the amount of the deviation of the ruled line in the test pattern when the flushing interval is set to 20 s is suppressed to be within 20 μm. Accordingly, much higher landing position accuracy is maintained, and an improvement of the throughput and a reduction of the ink consumption can be expected.

In addition, in the embodiment, the communication opening substrate 13 is provided between the nozzle substrate 15 and the pressure chamber substrate 14, and the nozzle communication opening 36 communicates with the pressure chamber 20 and the nozzle 23. Accordingly, by adjusting the capacity of the nozzle communication opening 36, it is possible to set the individual flow path capacity to be 4400 pl without greatly changing the capacity of the pressure chamber 20, that is, without changing the height of the partition 20' which separates the pressure chambers 20. Accordingly, since the deterioration of the rigidity of the partition 20' is prevented, it is possible to suppress the generation of the so-called adjacent crosstalk. In addition, the length of the pressure chamber 20 is not longer than necessary, and thus it is possible to suppress the size of the recording head 2 to be as small as possible.

In addition, the individual flow path capacity is allowed to have an error within ±1%.

However, the invention is not limited to the above-described embodiment, and can have various modifications based on the description of the range of the claims.

For example, the recording head 2 in the above-described embodiment is configured to have the nozzles 23 formed in a row shape (nozzle row which is parallel to the auxiliary scanning direction orthogonal to the main scanning direction), but is not limited thereto. For example, a configuration in which the nozzles are provided in parallel in a diagonal direction to the main scanning direction or the auxiliary scanning direction, or a configuration in which the nozzles are disposed in a matrix form can be employed in the invention. In the liquid ejecting head with such a configuration, if the minimum distance (distance between the centers) between the nozzles is 1/300 inches or less, a similar problem is generated. Therefore, by setting the capacity of the portion which corresponds to the above-described individual flow path to be 4400 pl or higher, a similar operational effect as the above-described effect can be expected.

In addition, a pressure generating means is not limited to the piezoelectric element 18 which is illustrated as an example. For example, even in a configuration in which another pressure generating means, such as a heating element, or an electrostatic actuator, is used, the invention can be employed.

In each of the above-described embodiments, the recording head 2 which ejects the ink is described as an example of the liquid ejecting head of the invention, however, the invention is not limited thereto. It is also possible to employ the invention, for example, in a coloring material ejecting head for a display manufacturing apparatus which ejects a solution of each coloring material of red (R), green (G), and blue (B), in an electrode material ejecting head for an electrode forming apparatus which ejects a liquid electrode material, in a bio-organic material ejecting head for a chip manufacturing apparatus which ejects of a bio-organic material solution, or the like.

What is claimed is:

1. A liquid ejecting head, comprising:

a plurality of nozzles which eject liquid;

a plurality of pressure chambers, wherein a pressure chamber of the plurality of pressure chambers is in communication with a nozzle of the plurality of nozzles, the plurality of pressure chambers being located along a first direction and being in parallel in the first direction, with a partition interposed between each successive pressure chamber in the first direction; and a plurality of liquid supply paths, wherein a liquid supply path of the plurality of liquid supply paths is in communication with and supplies the liquid to the pressure chamber of the plurality of pressure chambers, wherein a communication opening is provided between the nozzle of the plurality of nozzles and the pressure chamber of the plurality of pressure chambers, wherein a shortest formation pitch between each of the nozzles in the first direction is equal to or less than 1/300 inches, the shortest formation pitch being for the plurality of pressure chambers that are parallel in the first direction, with a partition interposed between each successive pressure chamber in the first direction, wherein a capacity of a flow path from an opening of the liquid supply path in the pressure chamber to the nozzle is equal to or higher than 4400 pl, wherein a communication opening substrate in which the communication opening is established is provided between a pressure chamber substrate on which the pressure chamber is formed and a nozzle substrate on which the nozzle is formed, and wherein a thickness of the communication opening substrate is equal to or more than 200 μm.

2. A liquid ejecting head, comprising:

a plurality of nozzles which eject liquid;

a plurality of pressure chambers, wherein a pressure chamber of the plurality of pressure chambers is in communication with a nozzle of the plurality of nozzles, the plurality of pressure chambers being located along a first direction and being in parallel in the first direction, with a partition interposed between each successive pressure chamber in the first direction, the partition being elongated in a second direction that is orthogonal to the first direction; and a plurality of liquid supply paths, wherein a liquid supply path of the plurality of liquid supply paths is in communication with and supplies the liquid to the pressure chamber of the plurality of pressure chambers, wherein a shortest formation pitch between each of the nozzles in the first direction is equal to or less than 1/300 inches, the shortest formation pitch being for the plurality of pressure chambers that are parallel in the first direction, with a partition interposed between each successive pressure chamber in the first direction, wherein a capacity of a flow path from an opening of the liquid supply path in the pressure chamber to the nozzle is equal to or higher than 4400 pl, and wherein a size of the pressure chamber is equal to or less than 569 μm in the second direction.

3. A liquid ejecting head, comprising:

a plurality of nozzles which eject liquid;

a plurality of pressure chambers, wherein a pressure chamber of the plurality of pressure chambers is in communication with a nozzle of the plurality of nozzles, the plurality of pressure chambers being located along a first direction and being in parallel in the first direction, with a partition interposed between each successive pressure chamber in the first direction, the partition being elongated in a second direction that is orthogonal to the first direction; and a plurality of liquid supply paths, wherein a liquid supply path of the plurality of liquid supply paths is in communication with and supplies the liquid to the pressure chamber of the plurality of pressure chambers, wherein a shortest formation pitch between each of the nozzles in the first direction is equal to or less than 1/300 inches, the shortest formation pitch being for the plurality of pressure chambers that are parallel in the first direction, with a partition interposed between each successive pressure chamber in the first direction, wherein a capacity of a flow path from an opening of the liquid supply path to the nozzle in the pressure chamber is equal to or higher than 4400 pl and is equal to or less than 6384 pl, and wherein a size of the pressure chamber is equal to or less than 569 μm in the second direction.

4. The liquid ejecting head according claim 3, wherein the capacity of a flow path from an opening of the liquid supply path to the nozzle in the pressure chamber is equal to or less than 6210 pl.

5. The liquid ejecting head according to claim 3, wherein a size of the pressure chamber is equal to or less than 70 μm in the first direction.

6. The liquid ejecting head according to claim 3, wherein a size of the pressure chamber is equal to or less than 70 μm in a third direction which is orthogonal to the first direction and a second direction, the second direction being orthogonal to the first direction.

7. A liquid ejecting head, comprising:

a plurality of nozzles which eject liquid;

a plurality of pressure chambers, wherein a pressure chamber of the plurality of pressure chambers is in communication with a nozzle of the plurality of nozzles, the plurality of pressure chambers being located along a first direction and being in parallel in the first direction, with a partition interposed between each successive pressure chamber in the first direction; and a plurality of liquid supply paths, wherein a liquid supply path of the plurality of liquid supply paths is in communication with and supplies the liquid to the pressure chamber of the plurality of pressure chambers, wherein a communication opening is provided between the nozzle of the plurality of nozzles and the pressure chamber of the plurality of pressure chambers, wherein a shortest formation pitch between each of the pressure chambers in the first direction is equal to or less than 1/300 inches, the shortest formation pitch being for the plurality of pressure chambers that are parallel in the first direction, with a partition interposed between each successive pressure chamber in the first direction, wherein a capacity of a flow path from an opening of the liquid supply path in the pressure chamber to the nozzle is equal to or higher than 4400 pl, wherein a communication opening substrate in which the communication opening is established is provided between a pressure chamber substrate on which the pressure chamber is formed and a nozzle substrate on which the nozzle is formed, and wherein a thickness of the communication opening substrate is equal to or more than 200 μm.

8. A liquid ejecting head, comprising:

a plurality of nozzles which eject liquid;

a plurality of pressure chambers, wherein a pressure chamber of the plurality of pressure chambers is in communication with a nozzle of the plurality of nozzles, the plurality of pressure chambers) being located along a first direction and being in parallel in the first direction, with a partition interposed between each successive pressure chamber in the first direction, the partition being elongated in a second direction that is orthogonal to the first direction; and a plurality of liquid supply paths, wherein a liquid supply path of the plurality of liquid supply paths is in communication with and supplies the liquid to the pressure chamber of the plurality of pressure chambers, wherein a shortest formation pitch between each of the pressure chambers in the first direction is equal to or less than 1/300 inches, the shortest formation pitch being for the plurality of pressure chambers that are parallel in the first direction, with a partition interposed between each successive pressure chamber in the first direction, and wherein a capacity of a flow path from an opening of the liquid supply path in the pressure chamber to the nozzle is equal to or higher than 4400 pl, and wherein a size of the pressure chamber is equal to or less than 569 μm in the second direction.

9. A liquid ejecting head, comprising:

a plurality of nozzles which eject liquid;

a plurality of pressure chambers, wherein a pressure chamber of the plurality of pressure chambers is in communication with a nozzle of the plurality of nozzles, the plurality of pressure chambers being located along a first direction and in a same position in a second direction that is orthogonal to the first direction; and a plurality of liquid supply paths, wherein a liquid supply path of the plurality of liquid supply paths is in communication with and supplies the liquid to the pressure chamber of the plurality of pressure chambers, wherein a shortest formation pitch between each of the pressure chambers in the first direction is equal to or less than 1/300 inches, the shortest formation pitch being for the plurality of pressure chambers that are parallel in the first direction, with a partition interposed between each successive pressure chamber in the first direction, wherein a capacity of a flow path from an opening of the liquid supply path to the nozzle in the pressure chamber is equal to or higher than 4400 pl and is equal to or less than 6384 pl, and wherein a size of the pressure chamber is equal to or less than 569 μm in the second direction.

10. The liquid ejecting head according claim 9, wherein the capacity of a flow path from an opening of the liquid supply path to the nozzle in the pressure chamber is equal to or less than 6210 pl.

11. The liquid ejecting head according to claim 9, wherein a size of the pressure chamber is equal to or less than 70 μm in the first direction.

12. The liquid ejecting head according to claim 9, wherein a size of the pressure chamber is equal to or less than 70 μm in a third direction which is orthogonal to the first direction and a second direction, the second direction being orthogonal to the first direction.

13. A liquid ejecting apparatus comprising the liquid ejecting head according to claim 1.

14. A liquid ejecting apparatus comprising the liquid ejecting head according to claim 2.

15. A liquid ejecting apparatus comprising the liquid ejecting head according to claim 3.

16. A liquid ejecting apparatus comprising the liquid ejecting head according to claim 7.

17. A liquid ejecting apparatus comprising the liquid ejecting head according to claim 8.

18. A liquid ejecting apparatus comprising the liquid ejecting head according to claim 9.

* * * * *